United States Patent [19]

Hess et al.

[11] 4,354,073

[45] Oct. 12, 1982

[54] ELECTRIC GAS BLAST CIRCUIT BREAKER

[75] Inventors: Ruediger Hess; Heiner Marin, both of Berlin, Fed. Rep. of Germany

[73] Assignee: Siemens Aktiengesellschaft, Berlin and Munich, Fed. Rep. of Germany

[21] Appl. No.: 126,206

[22] Filed: Mar. 3, 1980

[30] Foreign Application Priority Data

Nov. 21, 1979 [DE] Fed. Rep. of Germany ..... 2908982

[51] Int. Cl.[3] ..... H01H 33/88

[52] U.S. Cl. ..... 200/148 A

[58] Field of Search ..... 200/148 A, 148 G

[56] References Cited

U.S. PATENT DOCUMENTS 4,080,521 3/1978 Goedecke et al. ..... 200/148 G

FOREIGN PATENT DOCUMENTS 1264927 2/1972 United Kingdom ..... 200/148 A

*Primary Examiner*—Robert S. Macon

*Attorney, Agent, or Firm*—Spellman, Joel & Pelton

[57] ABSTRACT

An electric gas blast circuit breaker is disclosed which has two stationary contact pieces. A switching unit is movable between closed and open positions for electrically bridging the contact pieces in the closed position and for electrically disconnecting the contact pieces in the open position whereby an arc develops when the switching unit is moved to the open position. A gas blast device blasts a stream of gas through the arc when the switching unit is moved to the open position. The switching unit includes a supporting body and a slide-contact ring made of an arc-resistant material. The ring slideably contacts one of the contact pieces in the closed position and is mounted on the supporting body so as to be electrically insulated therefrom. A plurality of elongated contact elements are disposed in the supporting body for electrically connecting the contact pieces when the switching unit is in the closed position. There is provided an electrical connection between at least one of the contact elements and the slide-contact ring when the switching unit is in the closed position and also when it moves into the open position and continuously in all operating positions thereof.

8 Claims, 3 Drawing Figures

ELECTRIC GAS BLAST CIRCUIT BREAKER

BACKGROUND OF THE INVENTION

1. Field of the Invention

This invention relates to an electric gas blast circuit breaker, and more particularly structural elements for reducing arcing and burning as the breaker contacts open. The invention relates to an electric gas blast circuit breaker of the type having a gas blast device formed by a blast cylinder and a blast piston, having two stationary contact pieces, and having a switching unit movable between closed and open positions for electrically bridging the contact pieces in the closed position and for electrically disconnecting the contact pieces in the open position. In such a circuit breaker, the switching unit includes a tubular supporting body, a slide-contact ring made of arc-resistant material slideably contacting one of the two contact pieces in the closed position, this slide-contact ring being mounted on the supporting body so as to be electrically insulated therefrom, and a plurality of elongated contact elements or contact fingers disposed in the supporting body for electrically connecting the two contact pieces when the switching unit is in the closed position. The contact pieces preferably have a configuration as nozzles at their respective end faces disposed opposite each other.

2. Description of the Prior Art

U.S. Pat. No. 3,789,175 discloses a gas blast circuit breaker of the type above mentioned. In the closed position, the contact surfaces of the contact elements are spring pressed against the cylindrical outside surface of the stationary contact pieces. The electric current flows along the contact elements, and the slide-contact ring is electrically connected to the one contact piece or run-off contact piece. In the closed position, the slide-contact ring is electrically disconnected from the contact elements. Only in the course of the opening motion are the contact elements electrically connected to the slide-contact ring. This will occur immediately prior to the separation of the contact elements from the one stationary contact piece which at this moment is still electrically connected to the slide-contact ring. The contact elements which move radially to the circuit breaker axis will engage a rim projecting from the end face of the slide-contact ring which rim fixedly limits such movement.

In the course of the opening motion, the current must be commutated from the contact elements to the slide-contact ring. In circuit breakers for high normal or short-circuit currents, this commutation may be delayed, when the contact elements slide beyond the stationary contact piece due to the inertia of the contact elements, which are large in cross section. Accordingly, an increased burning may occur on the contact elements. In addition, the metal vapor which will appear during the burning off may affect the contact rating of the circuit breaker.

SUMMARY OF THE INVENTION

1. Objects

An object of this invention is to provide an electric gas blast circuit breaker having improved opening characteristics.

Another object of this invention is to provide an electric gas blast circuit breaker wherein the disconnection performance and the working life of the contact elements is improved.

Another object of this invention is to provide a gas blast circuit breaker which has the capability to reliably switch off short-circuit currents in the order of or in excess of 60 kiloamperes when a transmission line fault occurs.

Still another object of the invention is to provide a gas blast circuit breaker which during the opening motion commutates the current from the contact elements to a slide-contact ring without any delay.

2. Summary

According to this invention, an electric gas blast circuit breaker includes two stationary contact pieces and a switching member in the form of a switching unit which is movable between closed and open positions for electrically bridging the contact pieces in the closed position and for electrically disconnecting the contact pieces in the open position, whereby an arc develops when the switching unit is moved to the open position. A gas blast device is provided for blasting a stream of gas through the arc when the switching unit is moved to the open position. The switching unit includes a supporting body and a slide-contact ring made of arc-resistant material. The ring slideably contacts one of the two contact pieces in the closed position. The slide-contact ring is mounted in the supporting body so as to be electrically insulated therefrom. A plurality of elongated contact elements are disposed in the supporting body for electrically connecting the contact pieces when the switching unit is in the closed position. Connecting means are provided for electrically connecting at least one of the contact elements with the slide-contact ring when the switching unit is in the closed position and also when it moves into the open position.

Preferably the connecting means permanently connect the one contact element with the slide-contact ring in all operation positions.

By application of the invention, the current will be commutated from the contact elements to the slide-contact ring without any delay. Therefore, a generation of larger amounts of metal vapor from the contact elements under the influence of the arc can be avoided.

In the contact system of the circuit breaker according to the invention, the slide-contact ring is not directly conductively connected to the tubular supporting body so that only one main current path will be formed along all contact elements. This provides the advantage that a weakening of the contact pressure due to parallel current paths cannot occur.

In a preferred first embodiment of the electric gas blast circuit breaker according to the invention, a contact element is pressed against the slide-contact ring resiliently.

In this embodiment, the contact element itself may be assigned with play to the one stationary run-off contact piece and thus may permanently load the slide-contact ring. However, it is also possible to provide the slide-contact ring with a raised support in the area of the contact element. Such a support should not admit the contact element to engage the run-off contact piece. By means of such a support, a permanent electrically conducting connection can be maintained.

In a preferred second embodiment of the electric gas blast circuit breaker according to the invention, the electrical connection of the contact element with the slide-contact ring is provided by an electrically conductive flexible ribbon. This embodiment provides the advantages that all contact elements will participate directly in conducting short-circuit current and that the slide-contact ring will have the same electric potential as the contact elements.

Although the invention is illustrated and described herein as an electric gas blast circuit breaker, it is nevertheless not intended to be limited to the details shown, since various modifications may be made therein within the scope and the range of the claims. The invention, however, together with additional objects and advantages will be best understood from the following description and in connection with the accompanying drawings.

DESCRIPTION OF THE PREFERRED EMBODIMENTS OF THE INVENTION

Figure 1:
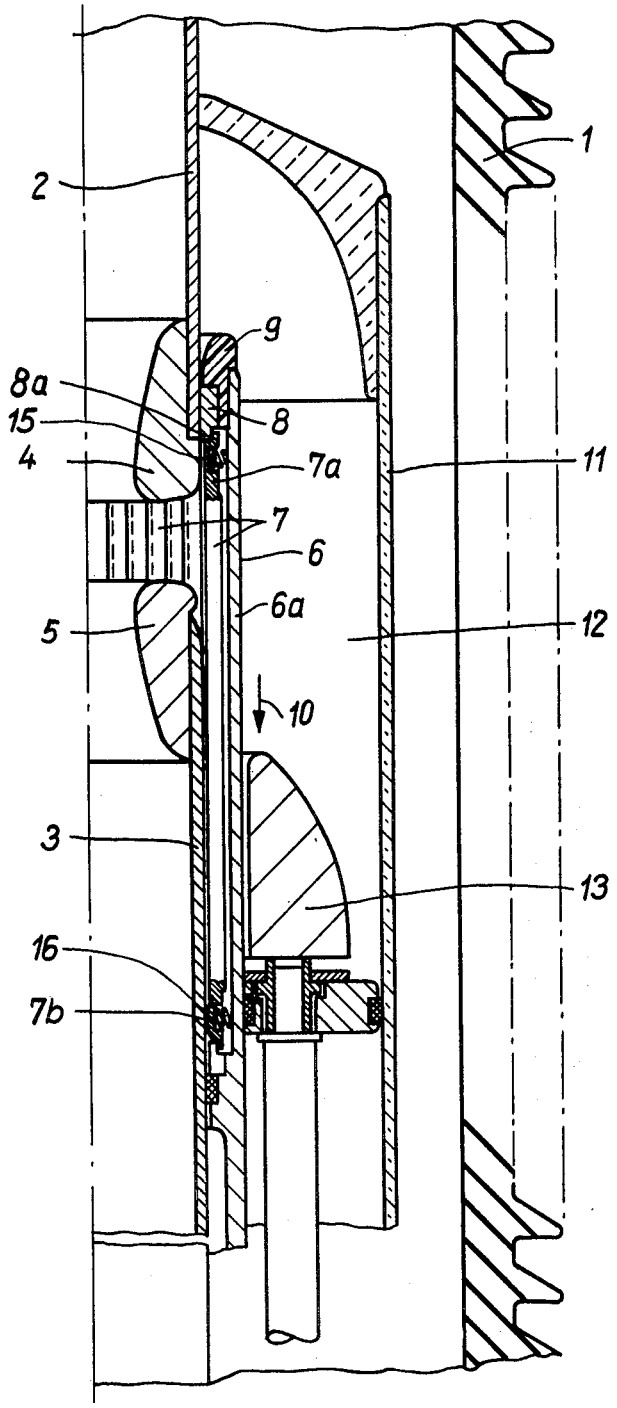
FIG. 1 is a schematic diagram, in longitudinal cross-section, of an electric gas blast circuit breaker according to the invention, wherein a permanent electric contact between a contact element and a slide-contact ring is maintained by a spring-loaded projection on the contact element.

The high-voltage circuit breaker of FIG. 1 can be operated, for example, at 110 to 170 kV and can use sulfur hexafluoride as the quenching and insulating medium. In order to more clearly depict the portions of the breaker pertinent to the invention, only those parts which are necessary for understanding the invention are shown. It is understood that M is the longitudinal axis or central line of the circuit breaker.

The electric circuit breaker is constructed as a gas blast circuit breaker and has a switching chamber 1 which consists, for example, of porcelain. Two stationary contact pieces 2 and 3 are arranged in the interior of the switching chamber 1. The contact pieces 2 and 3 carry nozzle pieces 4 and 5, respectively, at their respective end faces disposed opposite each other. The nozzle pieces 4 and 5 are made of an arc-resistant material.

In the closed position, the two stationary contact pieces 2 and 3 are connected by a switching unit in the form of a bridging contact member 6 having a tubular configuration. The bridging contact member 6 includes a tubular support member or hull 6*a* and a plurality of spring-loaded contact fingers or elongated contact elements 7 which are disposed inside the contact member 6 and which are distributed equally around the circumference. The tubular support member 6*a* carries a slide-contact ring 8 on its face end. The slide-contact ring 8 is made of an arc-resistant material. An electrical insulation 9 is interposed between the support member 6*a* and the slide-contact ring 8. The insulation 9 frames the ring 8.

In order to support the contact elements 7, the slide-contact ring 8 has a protrusion or projection 8*a* which is directed towards the contact elements 7. This projection 8*a* forms a contact rim. This projection 8*a* is located at that face of the sliding ring 8 which is located next to the gap between the nozzle pieces 4 and 5. One of the contact fingers 7, the contact finger 7*a*, has a corresponding recess at its one end. This recess matches the projection 8*a*. A spring element 15, preferably a small helical spring, is arranged between the bridging contact member 6 and the contact finger 7*a*. It is secured in an aperture in the contact element 7*a*. The spring element 15 is also located near the end of the contact element 7*a*. Therefore, the contact element 7*a* is permanently pushed against the slide-contact ring 8 in a resilient manner. The mechanical contact provides also a good and permanent electric contact between the contact finger 7*a* and the slide-contact element 8.

It should be noted that the end of the contact element 7*a* which is in electric contact with the slide-contact ring 8, does not engage the run-off contact piece 2 or the nozzle piece 4.

The other end of the contact finger 7*a* is provided with a shoulder 7*b* to form a contact area. This shoulder 7*b* engages the contact piece 3. To this end, the contact finger 7*a* is spring-loaded by a spring element 16. In the closed position the contact piece 3 is electrically connected to the contact piece 4 via the shoulder 7*b*, the contact element 7*a* and the projection 8*a* of the slide-contact ring 8. The contact pieces 3 and 4 are also connected to each other by the other contact elements 7 which may be of conventional design.

Figure 2:
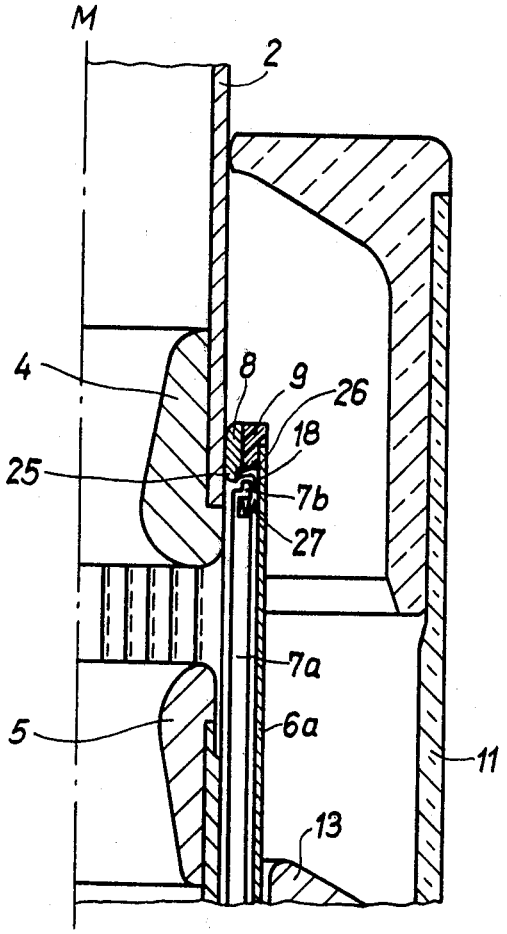
FIG. 2 illustrates a sectional view of another embodiment of an electric gas blast circuit breaker, wherein a permanent electric contact between a contact finger and a slide-contact ring is maintained by an electrically conductive flexible ribbon.

FIG. 2 shows that the contact finger 7*a* may be provided with contact shoulders 7*b* on both ends. The shoulder 7*b* illustrated in FIG. 2 engages the contact piece 2. Therefore, the contact finger 7*a* will participate in the current transmission like the other contact fingers 7. In this case, a permanent electric connection between the contact finger 7*a* and the slide-contact ring 8 is maintained by a flexible ribbon 18 which is electrically conductive.

Figure 3:
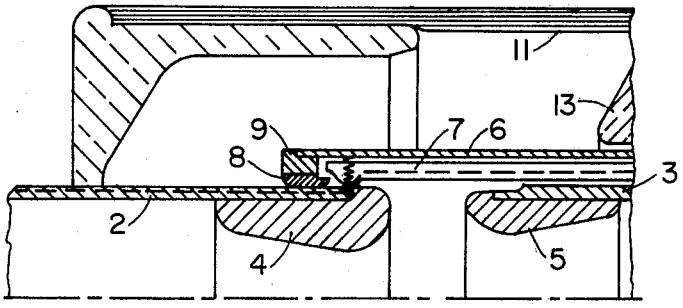
FIG. 3 (PRIOR ART)
FIG. 3 is a view (corresponding to FIG. 2 of U.S. Pat. No. 3,789,175) of a prior art electric gas blast circuit breaker showing a contact element of conventional design.

As in the conventional design of U.S. Pat. No. 3,789,175 (see FIG. 3), the shoulder 7*b* is pressed by a spring 27 against the outside surface of the contact piece 2. In the course of the opening motion, the contact finger 7*a*, just like the other fingers 7, rests with a projecting extension 26 on a protruding rim 25 of the slide-contact ring 8.

Returning now to FIG. 1, the operation of the circuit breaker will be briefly described. When the contact member 6 moves in the direction of the arrow 10, i.e. into the open position of the circuit breaker, the blast cylinder 11 of a blast device simultaneously will be moved into the same direction. The blast volume 12 surrounded by the blast cylinder 11 will be compressed against a relatively stationary piston 13 of the blast device.

During the run off from the stationary contact 2, commutation of the current from the contact elements 7, 7*a* to the slide-contact ring 8 is performed without any delay and independently from the inertia of the spring loaded contact elements 7, 7*a*. Run off as used herein means slideably breaking contact. When the annular isolation 9 also runs off the contact piece 2, the compressed gas will be driven into the interior of the nozzle pieces 4 and 5. An arc, drawn earlier between the slide-contact ring 8 and the nozzle piece 4, will commutate from the slide-contact ring 8 to the nozzle piece 5 during the following course of the opening motion. This arc will be blasted effectively in a known manner.

What is claimed is:

1. An electric gas blast circuit breaker having two stationary contact pieces, a switching unit movable between closed and open positions for electrically bridging said contact pieces in the closed position and for electrically disconnecting said contact pieces in the open position whereby an arc develops when said switching unit is moved to the open position, and gas blast means for blasting a stream of gas through the arc when said switching unit is moved to the open position, said switching unit including a supporting body, a slide contact ring made of arc-resistant material slideably contacting one of said contact pieces in the closed position, said ring being mounted on said supporting body so as to be electrically insulated therefrom, and a plurality of elongated contact elements disposed in said supporting body at least some of said contact elements making direct contact with and electrically connecting said contact pieces when said switching unit is in the closed position, and means for electrically connecting as least one of said contact elements with said slide-contact ring when said switching unit is in the closed position and through all movement thereof into the open position.

2. The improvement of claim 1, wherein said connecting means electrically connects said one contact element solely through said slide-contact ring to one of said contact pieces in closed position.

3. The improvement of claim 1, wherein a spring element provides resilient pressure for engaging said one contact element with said slide-contact ring providing electrical connection between said element and said ring throughout all operating positions of said unit.

4. The improvement of claim 3, wherein said slide-contact ring has an end face directed toward said contact elements and a rim projecting from said end face, and wherein said contact element has a projecting extension resting on said projecting rim of said slide-contact ring under the influence of said spring element throughout all operating positions of said switching unit.

5. The improvement of claim 4, wherein said one contact element has a first end and a second end, wherein said projecting extension is arranged on said first end, wherein a shoulder is provided on said second end to form a contact area, and wherein spring means are provided for spring loading said shoulder on the other of said contact pieces.

6. The improvement of claim 1, wherein an electrically conductive flexible ribbon is connected between said one contact element and said slide-contact ring providing electrical connection between said element and said ring throughout all operating positions of said unit.

7. The improvement of claim 6, wherein said one contact element has a first end and a second end, wherein means for spring loading said contact elements are provided on said first end, said spring loading means displacing said contact elements into electrically conductive contact with said slide-contact ring as said ring and said contact elements separate from said one contact piece when said switching unit moves into the open position, wherein a shoulder is provided on said second end to form a contact area, and wherein means are provided for spring loading said shoulder on the other one of said contact pieces.

8. The improvement of claim 7, wherein a layer of insulation material is disposed between said supporting body and said slide-contact ring, wherein said slide-contact ring has an end face directed toward said contact elements, and wherein said ring has a rim projecting from said end face to an extent sufficient to form a cage for said contact elements.

* * * * *